US009598147B2

(12) United States Patent
Templeton

(10) Patent No.: US 9,598,147 B2
(45) Date of Patent: Mar. 21, 2017

(54) BOAT CANOPY

(71) Applicant: Michael David Templeton, Goodrich, MI (US)

(72) Inventor: Michael David Templeton, Goodrich, MI (US)

( * ) Notice: Subject to any disclaimer, the term of this patent is extended or adjusted under 35 U.S.C. 154(b) by 0 days.

(21) Appl. No.: 13/941,527

(22) Filed: Jul. 14, 2013

(65) Prior Publication Data

US 2014/0026804 A1 Jan. 30, 2014

Related U.S. Application Data

(60) Provisional application No. 61/674,925, filed on Jul. 24, 2012, provisional application No. 61/815,107, filed on Apr. 23, 2013.

(51) Int. Cl.
*B63B 17/02* (2006.01)

(52) U.S. Cl.
CPC ..... *B63B 17/02* (2013.01)

(58) Field of Classification Search
CPC ..... B63B 17/02; B63B 2737/00; E04H 15/16; E04H 15/18; E04H 15/008
USPC ..... 135/160, 97, 906, 908, 155, 157, 158, 135/159, 94, 153, 154; 52/66; 114/361, 114/263; 111/160, 97, 906, 908, 155
See application file for complete search history.

(56) References Cited

U.S. PATENT DOCUMENTS 714,650 A * 11/1902 Truscott et al. ..... 135/155
1,295,713 A * 2/1919 Drohovith ..... 5/113
2,708,346 A * 5/1955 Smith ..... 405/3
2,769,451 A * 11/1956 Edgin ..... 135/147
2,930,387 A * 3/1960 Streich et al. ..... 135/137
3,083,540 A * 4/1963 Smith ..... 405/3
3,353,311 A * 11/1967 McClure et al. ..... 52/66
4,312,157 A * 1/1982 Hertel et al. ..... 52/13
5,152,109 A * 10/1992 Boers ..... 52/143
5,185,972 A * 2/1993 Markiewicz ..... 52/63
5,775,353 A * 7/1998 Johnson ..... 135/96
6,102,059 A * 8/2000 Miller ..... 135/87
6,688,252 B1 * 2/2004 Caravella ..... 114/361
6,763,633 B2 * 7/2004 Cote ..... 52/71
2001/0052356 A1 * 12/2001 Ross ..... 135/124
2005/0089375 A1 * 4/2005 Fox ..... 405/219
2005/0252542 A1 * 11/2005 Basta ..... 135/156

FOREIGN PATENT DOCUMENTS

WO WO 2009089584 A1 * 7/2009 ..... E04B 1/343

* cited by examiner

*Primary Examiner* — Noah Chandler Hawk
(74) *Attorney, Agent, or Firm* — Michael D. Templeton

(57) ABSTRACT

The present invention relates to methods and devices for the protection of marine vessels. In one exemplary embodiment, the present invention provides a canopy assembly for a boat. The canopy assembly includes a frame assembly having a frame member that is moveable with respect to an opposing member to which the frame member is rotatably attached thereto. The canopy assembly further includes one or more support members supporting the moveable frame member. The canopy assembly further includes one or more lift assists connected to the moveable frame member for assisting in the raising of the frame member with respect to the opposing member.

13 Claims, 8 Drawing Sheets

BOAT CANOPY

CROSS-REFERENCE TO RELATED APPLICATION

The present application claims benefit of U.S. Provisional Patent Application No. 61/674,925, filed Jul. 24, 2012, and U.S. Provisional Patent Application No. 61/815,107, filed Apr. 23, 2013, the contents of both are hereby incorporated by reference in their entirety for all purposes.

FIELD OF THE INVENTION

The present invention relates to methods and devices for the protection of marine vessels, particularly during storage, while providing improved access to interior compartments of the same.

BACKGROUND/DESCRIPTION OF PRIOR ART

Marine vessels, such as boats, jet skis, or otherwise, are often stored during nonuse to maintain cleanliness and reduce corrosion. Storage of marine vessels, particularly boats, may include hoists or lifts that are configured to maintain position of the boat or remove the boat from water. In certain instances, hoists or lifts are contained within or placed under storage roofs, covers, canopies or otherwise for additional protection from environmental conditions, such as rain, hail, snow, sun, or otherwise. With respect to covers and canopies, they are often placed directly over the marine vessels to limit exposure to the environmental conditions and provide concealment and protection from trespassers. However, while covers provide these protections, they also make it difficult to both exit and enter the boat.

Prior systems have attempted to provide easier entrance and egress from marine vessels from beneath covers and canopies; however, these systems are less than satisfactory. For example, in one configuration a canopy is provided that is supported by members that are configured to raise and lower the entire canopy. However, this system is particularly complex in design and expensive. In another configuration, moveable side members are provided for improving access to the vessel. However, this configuration is also unsatisfactory for aiding in the entrance and egress from the vessel, particularly for physically challenged individuals, as only slight improvement of access is achieved. More so, this configuration is insufficient for improving in the loading or unloading of larger marine equipment, such as certain fishing equipment, floatable safety equipment, marine bumper guards, storage containers for food or otherwise, and other large items commonly placed within and removed from marine vessels.

In view of the foregoing, there remains a need for improved entrance and egress from marine vessels disposed under covers and canopies.

SUMMARY OF THE INVENTION

The present invention relates to improved methods and devices for accessing marine vessels, particularly vessels disposed under covers and canopies. The features of the present invention provide improved entrance and egress from a marine vessel, and improved loading and removal of equipment for the same. Other advantages will be appreciated as shown and described herein. The advancements of the present invention are predicated upon a canopy assembly having a frame assembly configured, or having a portion configured, for movement so as to provide improvement in the accessing of equipment, entrance and egress and loading and unloading of supplies.

In greater detail, in one aspect, the present invention provides a canopy assembly for a boat. The canopy assembly includes a frame assembly including a first frame portion rotatably connected to a second frame portion through one or more hinges. The canopy assembly further includes one or more support members supporting the first frame portion and the second frame portion. The canopy assembly further includes a canopy disposed over the frame assembly. The canopy assembly further includes one or more lift assists configured to maintain a raised position of the first frame portion with respect to the second frame portion.

In another aspect, the present invention provides a canopy assembly for marine vessels. The canopy assembly includes a frame assembly including a first frame portion connectable to a second frame portion. The canopy assembly further includes one or more support members supporting the first frame portion and the second frame portion. The canopy assembly further includes a canopy generally disposed over the frame assembly. The canopy assembly further includes a guide assembly configured to move the first frame portion between an extended and a retracted position.

In another aspect, the present invention provides a canopy assembly for marine vessels. The canopy assembly includes a frame assembly including a front end portion, a rear end portion and oppositely disposed side portions. The canopy assembly further includes one or more support members supporting one of the oppositely disposed side portions and one or more support members supporting the other of said oppositely disposed side portions, the frame assembly fixedly attached to one side portion and detachably connected to the other of said oppositely disposed side portions. The canopy assembly further includes a canopy disposed over the frame assembly, wherein the frame assembly is rotatably connected to at least one of the one or more support members to allow rotation of the frame assembly between raised and lowered position.

The above-described and other features and advantages of the present invention will be appreciated and understood by those skilled in the art from the following detailed description, drawings, and appended claims.

BRIEF DESCRIPTION OF THE DRAWINGS

Other objects, features, advantages and details of the present invention appear, by way of example only, in the following detailed description of preferred embodiments of the invention, the detailed description referring to the drawings in which.

DESCRIPTION OF THE PREFERRED EMBODIMENTS

Figure 1:
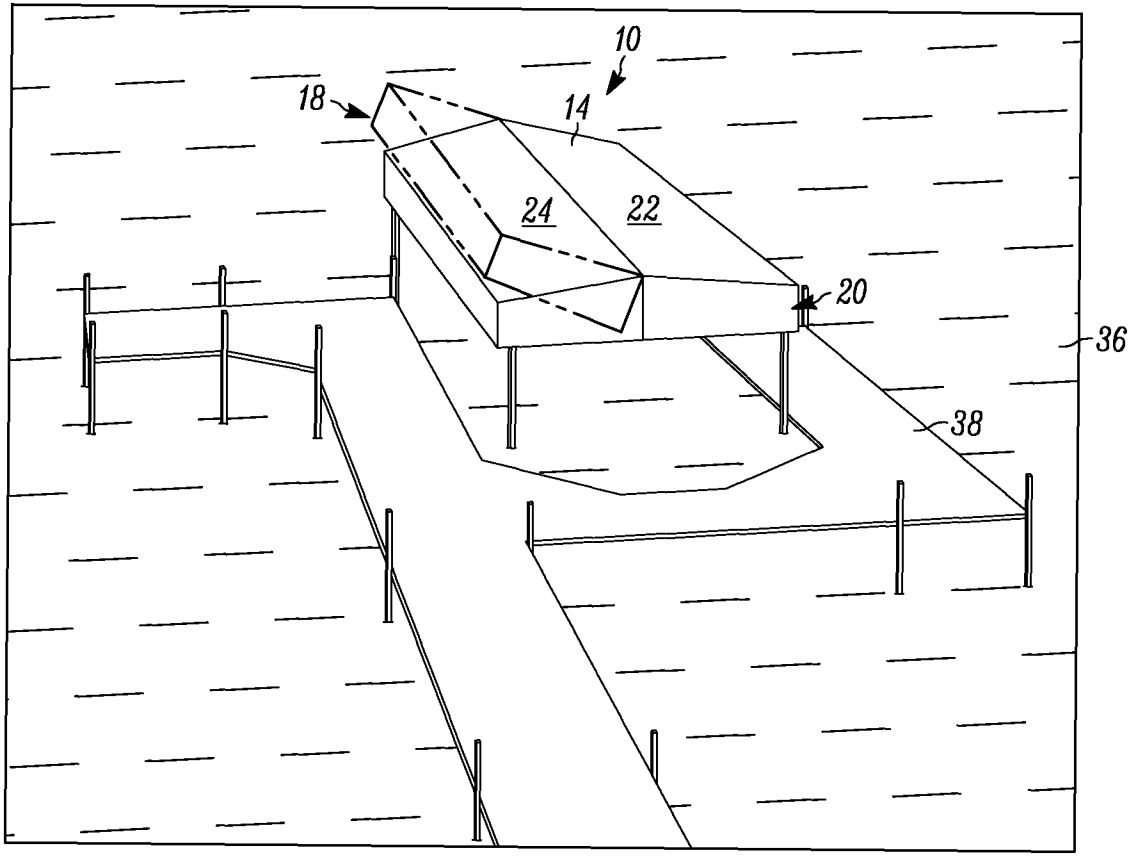
FIG. 1 illustrates a perspective view of an exemplary embodiment of a canopy assembly of the present invention.

Referring to FIGS. 1 through 10, embodiments of a canopy assembly 10 of the present invention are shown. The canopy assembly 10 includes a frame assembly 12 supporting a canopy 14. The frame assembly 12 and canopy 14 are suitable in size for housing and providing cover for a marine vessel 16. Non-limiting examples of marine vessels usable with the present invention includes row boats, recreational motor boats, fishing boats, pontoon boats, paddle boats and jet skis. However, other boats are also useable with the present invention including smaller or larger boats.

The canopy assembly 10 extends along an axis 'A' between a first end 18 and a second end 20. In the embodiments shown in FIGS. 3-9 and 12, the frame assembly 12 is bifurcated and includes a first frame half 22 disposed on one side of the axis 'A' and a second frame half 24 disposed on an opposite side of the axis 'A'. In one exemplary embodiment, the first and second frame halves include oppositely located end frame members 26, external side frame members 28, internal side frame members 30 and one or more lateral support frame members 32. In the embodiment shown in FIG. 11, the frame assembly 12 comprises a single frame member 23 extending a substantial portion of a width of the canopy assembly 10 and in one particular configuration includes external side frame members 28. The individual frame members or sections of the various embodiments provide increase structural integrity of the frame assembly 12, support of the canopy 14 as well as mounting structure for various additional components, such as shown or described herein. It should be appreciated that the frame assembly 12 may include more or less individual frame members or sections than shown or described. Further, it should be appreciated that one or more of the individual members or sections may be combined.

With respect to the embodiments shown in FIGS. 3-9, the first and second frame halves 22, 24 are rotatably mounted together through one or more, e.g. plurality, of hinges 25. In one exemplary embodiment, the canopy assembly 10 includes a single hinge, such as a piano hinge, extending between the first and second end 18, 20 of the canopy assembly, and along axis 'A'. In another exemplary embodiment, the canopy assembly 10 includes a plurality of hinges 25 located along axis 'A'. In this configuration, the hinges 25 are mounted proximate to internal side frame members 30 of the first and second frame half 22, 24.

Figure 12:
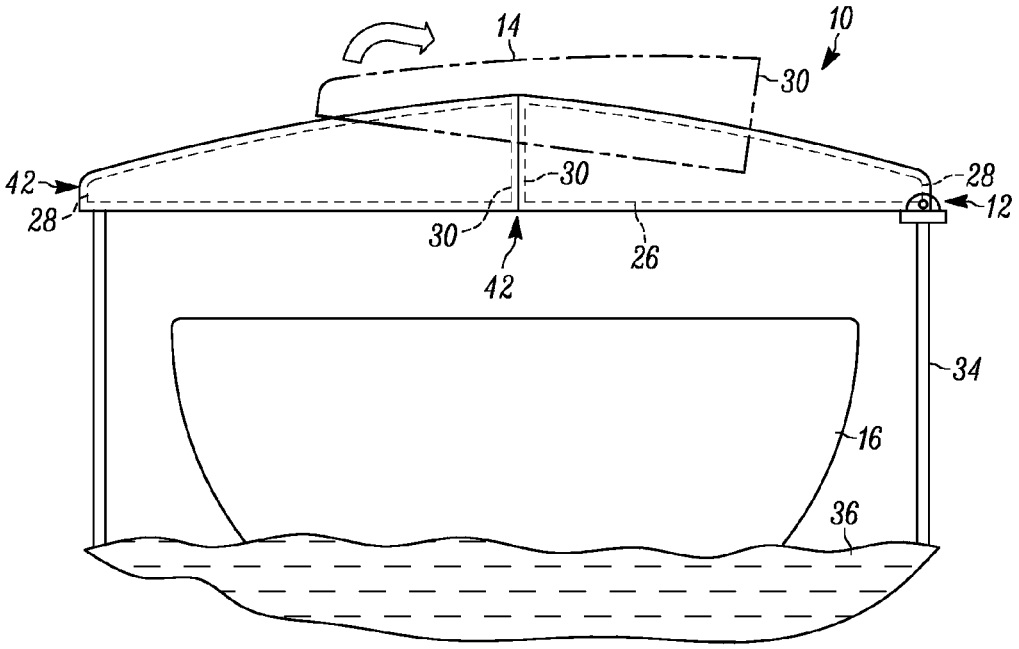
FIG. 12 illustrates a side elevational view of another exemplary embodiment of a canopy assembly of the present invention.

With respect to the embodiment shown in FIG. 12, the first and second frame halves 22, 24 are moveable with respect to one another and is configured and/or includes suitable guides and/or linkages for allowing movement of the first frame halve 22 with respect to the second frame halve 24.

Figure 11:
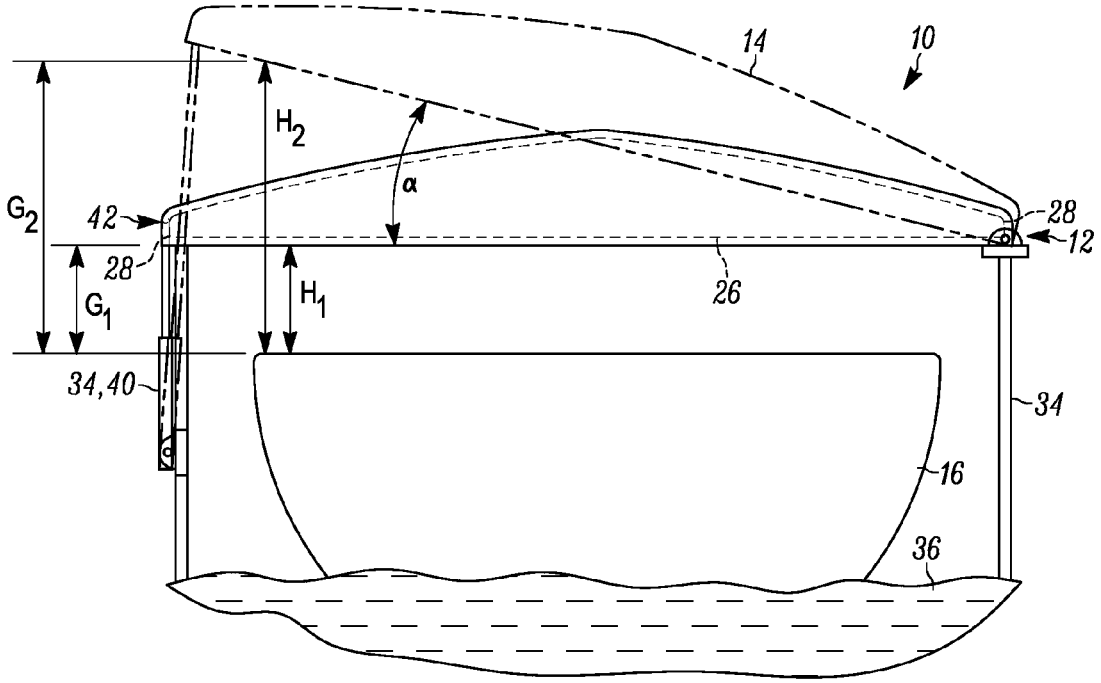
FIG. 11 illustrates a side elevational view of another exemplary embodiment of a canopy assembly of the present invention.

With respect to the embodiment shown in FIG. 11, the single frame member 23 is rotatably mounted to one or more support members 34 or members attached thereto. In one exemplary embodiment, the canopy assembly 10 includes a single hinge, such as a piano hinge, extending between the first and second end 18, 20 of the canopy assembly. In another exemplary embodiment, the canopy assembly 10 includes a plurality of hinges 25 mounting the single frame member to the support members 34.

The hinges 25 provide the ability to rotatably raise the first or second frame half 22, 24, or single frame member 23, with respect to the other of said first or second frame half, or frame portion. For example, referring to FIGS. 3 and 11, the second frame half 24, or single frame member 23, is configured to rotate and raise from a first height H1 to a second height H2. In these configurations, the first and second height H1, H2 are with respect to a top surface of a marine vessel 16, however, they may also be with respect to a surface of the water, surface of the dock or otherwise. In any regard, it is contemplated that the second height H2 is at least about 50%, 75%, 100%, 150%, 200% or more greater than that of the first height H1. Accordingly, it is contemplated that a gap, e.g. G1 and G2, formed between a top surface of the marine vessel 16, or otherwise, and a bottom surface of the second frame half 22, increases by at least about 50%, 75%, 100%, 150%, 200% or more. In another aspect, it is contemplated that the first frame half 22 or second frame half 24 rotates with respect to the other of said first or second frame half by an angle $\alpha$. To this extent, in one configuration, it is contemplated that the second frame half 24 rotates with respect to the first frame half 22 by an angle $\alpha$ of at least about 15°, 20°, 30°, 45° or more. Similarly, in another configuration, it is contemplated that the single frame member 23 rotates, with respect to a previous position, by an angle $\alpha$ of at least about 5°, 7°, 10°, 15° or more. Other configurations are possible.

The first and second frame halves 22, 24, and single frame member 23, are supported by or one or more, e.g. plurality, of support members 34. In several exemplary embodiments, referring to FIGS. 3 and 11, the first and second frame halves 22, 24, and single frame member 23, are supported by a plurality of support members 34. In the configurations shown, the first frame half 22 is supported by support members 34 extending from below the surface of a body of water 36 and is further supported by a bed surface of the body of water, though additional supports may be used. The second frame half 24 is supported by support members 34 extending from and supported by a dock 38. The single frame member 23 is supported on one side by a plurality of support members 34 extending from below the surface of a body of water 36 and on another side by support members 34 extending from and supported by a dock 38. It should be appreciated that both the first and second frame halves 22, 24, and single frame member 23, may be supported by support members 34 extending from a body of water or support members extending from a dock, or otherwise, and should not be considered limiting.

Figure 3:
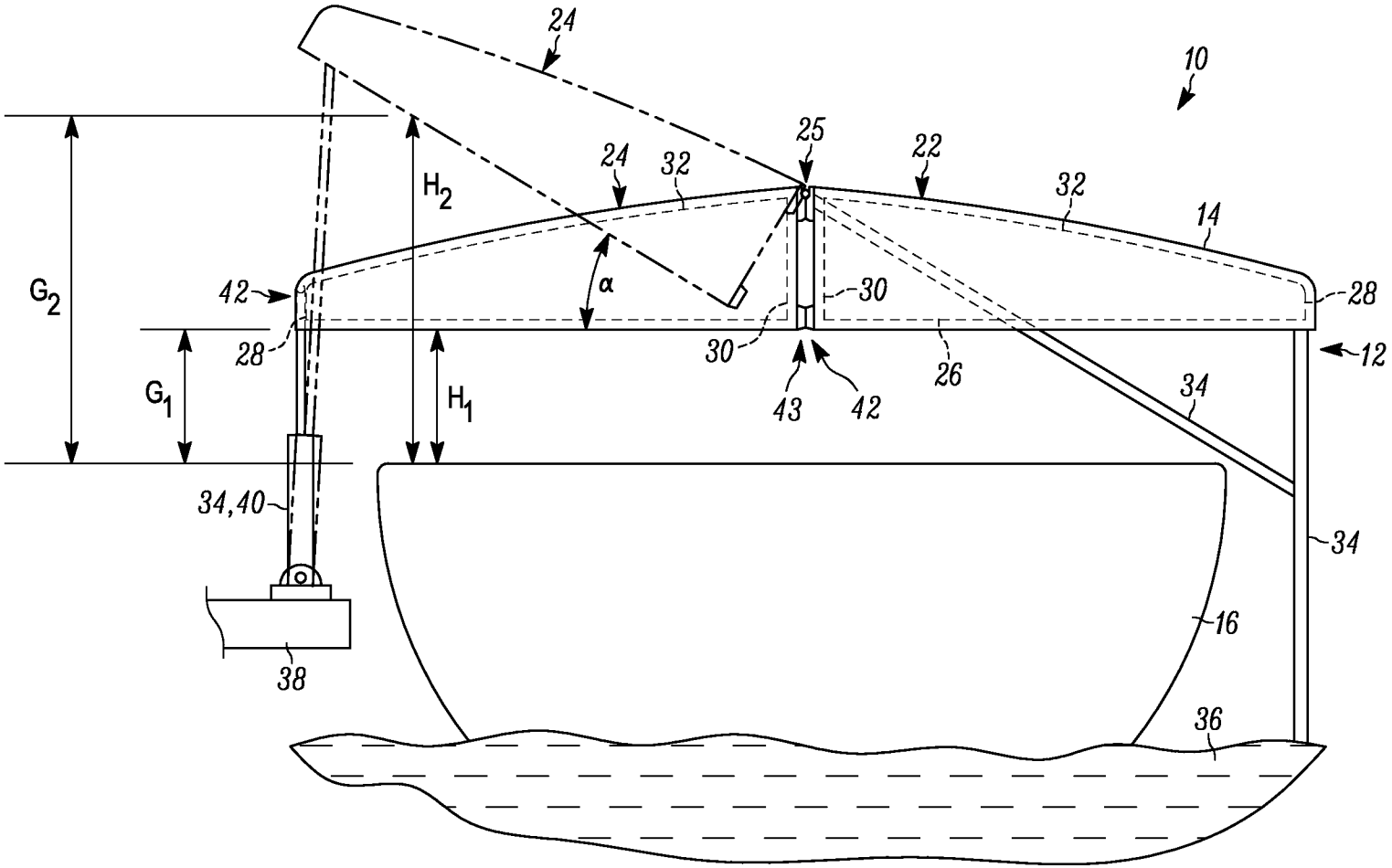
FIG. 3 illustrates a side elevational view of another exemplary embodiment of a canopy assembly of the present invention.

With continued reference to the embodiments shown in FIGS. 3 and 11, the canopy assembly 10 includes one or more, e.g. plurality, of lift assists 40 for assisting in the raising of the first or second frame half 22, 24, and single frame member 23, from the first height H1 to the second height H2. The lift assist 40 may have a dual function of both providing lift and support. Accordingly, it is contemplated that a lift assist 40 may also comprise a support member 34. For example, referring to FIG. 3, the support member 34 of the second frame half 24 also comprises a lift assist 40. In this configuration, the lift assist 40 is rotatably mounted to both the dock 38 and the second frame half 24 to eliminate binding between the lift assist and second frame half 24 during rotation of the second frame half 24 with respect to the first frame half 22.

The lift assist 40 provides upward vertical force of the first or second frame half 22, 24, and single frame member 23, through hydraulics, pneumatics, spring mechanics, motor or otherwise. The lift assist 40 of the present invention may comprise any suitable lift assist, such as those used to lift back hatches of vehicles. Other contemplated lift assists comprise power driven hydraulics or pneumatics. Other configurations are possible. In one exemplary embodiment, the lift assist 40 is remotely operated so that the first frame half 22, second frame half 24, and single frame member 23, or both, are raised as the marine vessel 16 or individual approaches the canopy assembly 10, via body of water 36 or dock 38.

Figure 4:
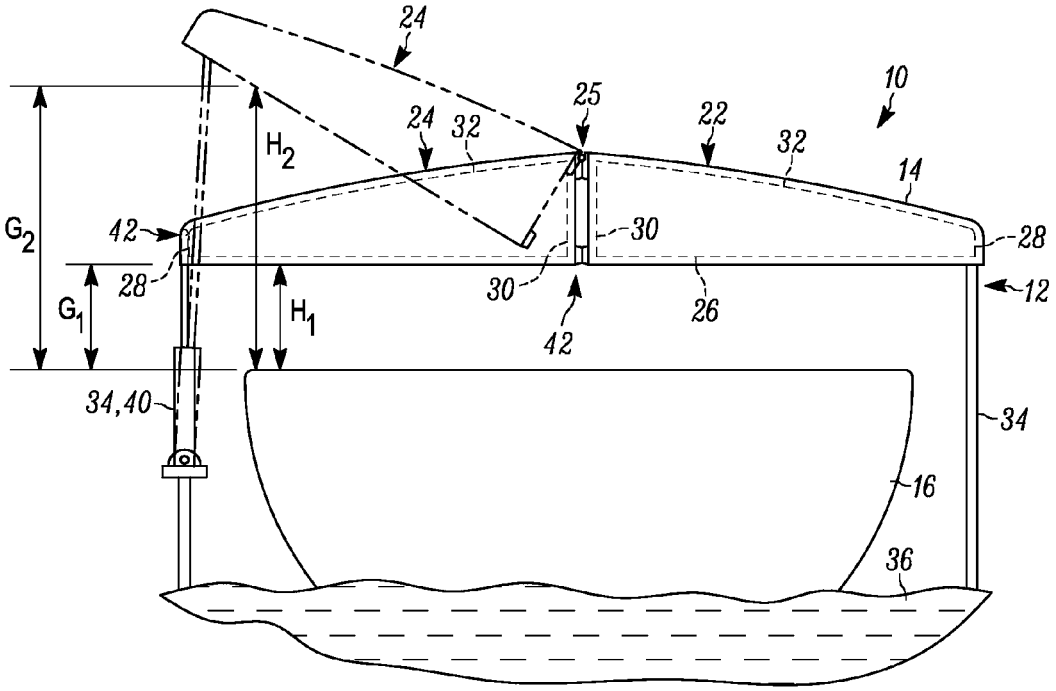
FIG. 4 illustrates a side elevational view of another exemplary embodiment of a canopy assembly of the present invention.

In another embodiment, referring to FIG. 4, a similar canopy assembly 10 to FIG. 3 is shown. In this embodiment, the lift assist 40 is attached directly to a support member 34, through suitable fasteners or fastening techniques, or is otherwise incorporated, combined or integrated with a support member. In this regard, the combined lift assist 40 and support member 34 extend from and is supported by a bed surface of a body of water. With respect to operation, the second frame half 24 raises and lowers in a similar manner to the embodiment shown in FIG. 3.

Figure 5:
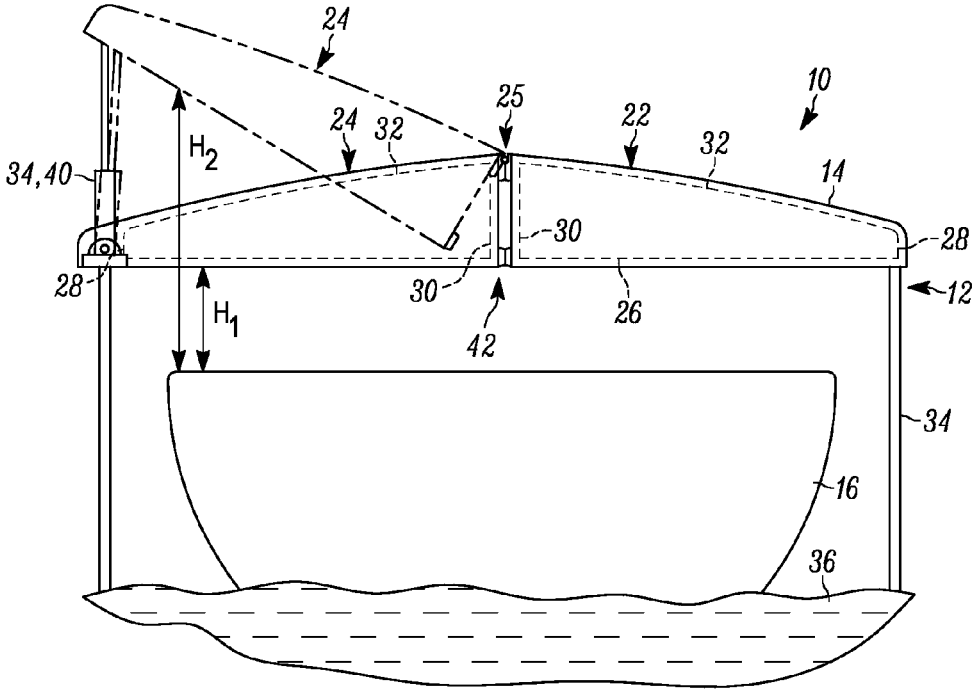
FIG. 5 illustrates a side elevational view of another exemplary embodiment of a canopy assembly of the present invention.

In another embodiment, referring to FIG. 5, another similar canopy assembly 10 to FIG. 3 is shown. In this embodiment, as with FIG. 4, the lift assist 40 is attached directly to a support member 34, through suitable fasteners or fastening techniques, or is otherwise incorporated, combined or integrated with a support member. However, in this embodiment, the lift assist 40 is surrounded by the second frame half 24 and is obscured by the canopy 14 while in a down position. As the second frame half 24 is raised, the lift assist 40 becomes visible.

Figure 6:
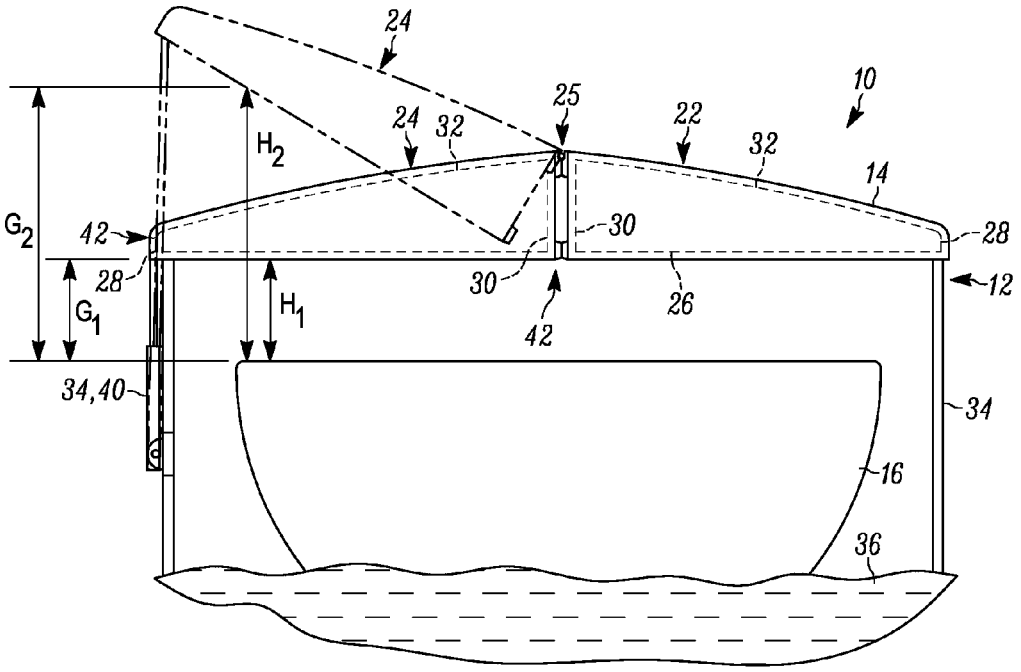
FIG. 6 illustrates a side elevational view of another exemplary embodiment of a canopy assembly of the present invention.

In another embodiment, referring to FIGS. 6 and 11, other similar canopy assemblies 10 to FIG. 3 are shown. In these embodiments, the lift assist 40 is attached directly to a support member 34, through suitable fasteners and brackets or other fastening technique. Specifically, a base portion of the lift assist is vertically orientated and attached through fasteners, brackets or otherwise to provide a low cost lift system that is usable with both new systems and existing systems. In this regards, the support member 34 extends from and is supported by a bed surface of a body of water. With respect to operation, the second frame half 24 raises and lowers in a similar manner to the embodiment shown in FIG. 3.

Figure 7:
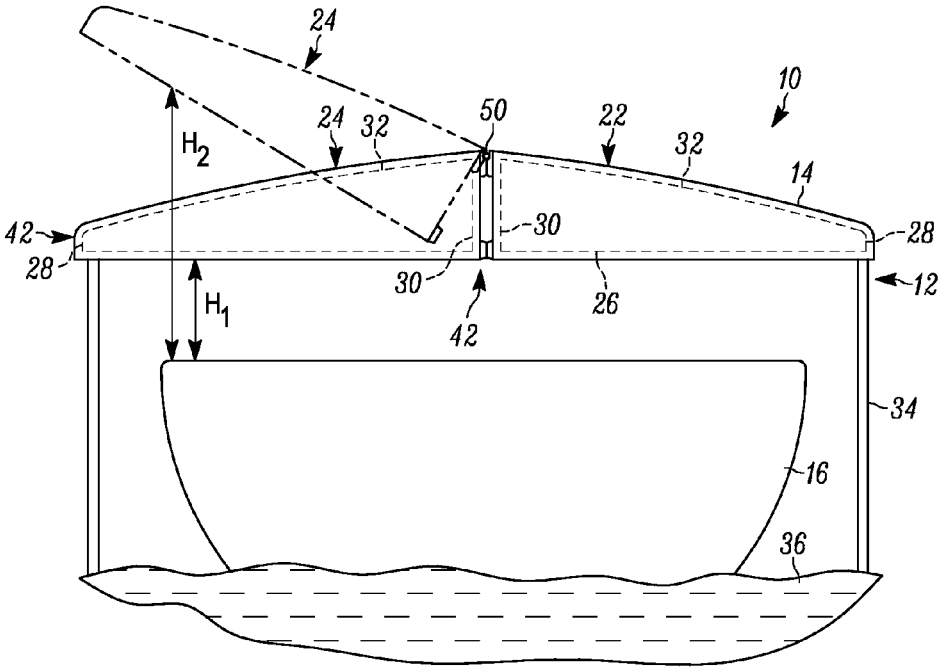
FIG. 7 illustrates a side elevational view of another exemplary embodiment of a canopy assembly of the present invention.

In another embodiment, referring to FIG. 7, another similar canopy assembly 10 to FIG. 3 is shown. In this embodiment, the lift assist 40 includes a gear system 50, similar to lawn chair configurations, that allow the second frame half 24 to be raised and locked into a raised position. It is contemplated, though not necessary, that spring members are used to assist in raising and lowering of the second frame half 24. To lower the second frame half 24, the gears are disengaged or manipulated, through movement or other manipulation, to allow the second frame half 24 to be lowered.

Figure 8:
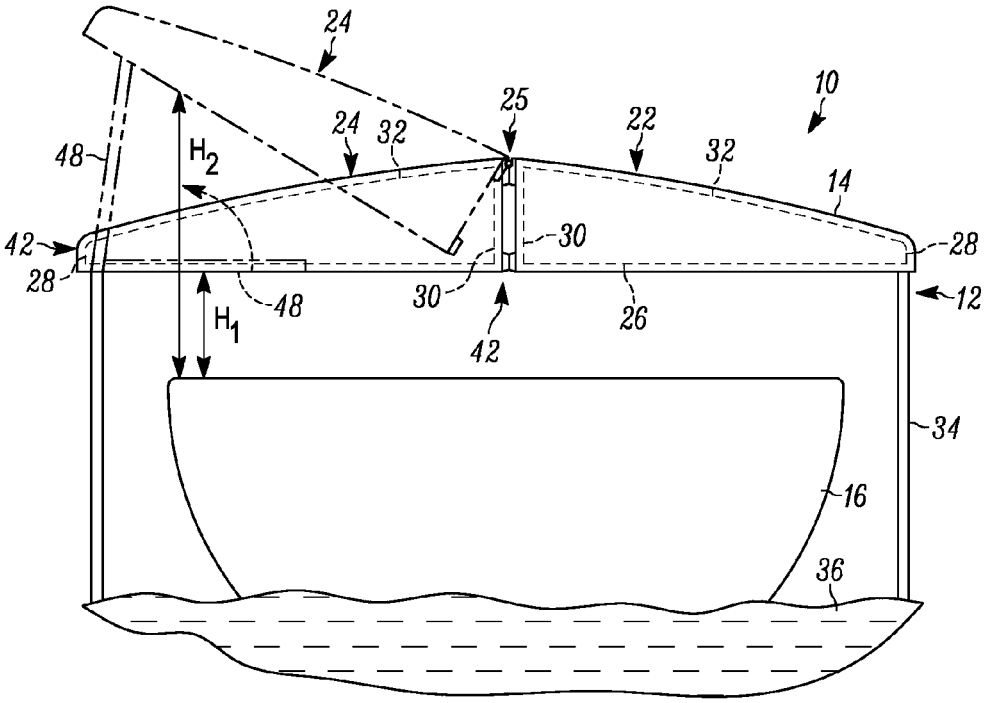
FIG. 8 illustrates a side elevational view of another exemplary embodiment of a canopy assembly of the present invention.

In another embodiment, referring to FIG. 8, another similar canopy assembly 10 to FIG. 3 is shown. In this embodiment, the canopy does not includes a lift assist, but instead, includes a lift support rod 48 configured to maintain the second frame half 24 in a raised position. In this configuration, the lift support rod 48 is rotatably mounted to a support member 34 to allow movement between a raised position and a stowed position. In the stowed position, it is contemplated that a clip or other holding member may be used to maintain the rod under the canopy 14 so it is hidden or less noticeable.

Figure 9:
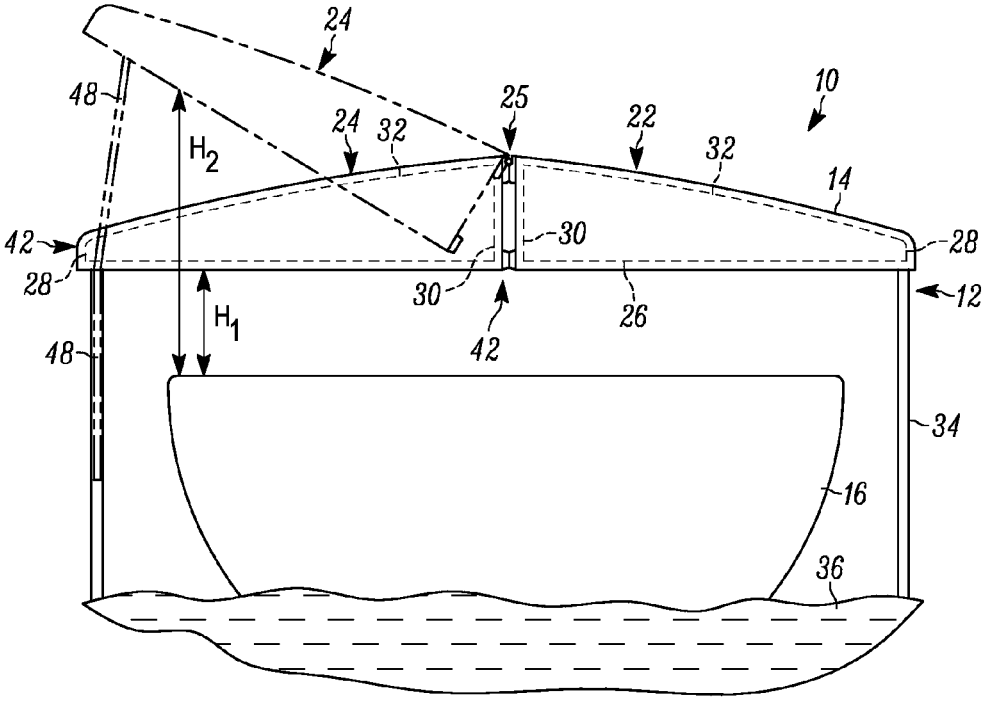
FIG. 9 illustrates a side elevational view of another exemplary embodiment of a canopy assembly of the present invention.
Figure 10:
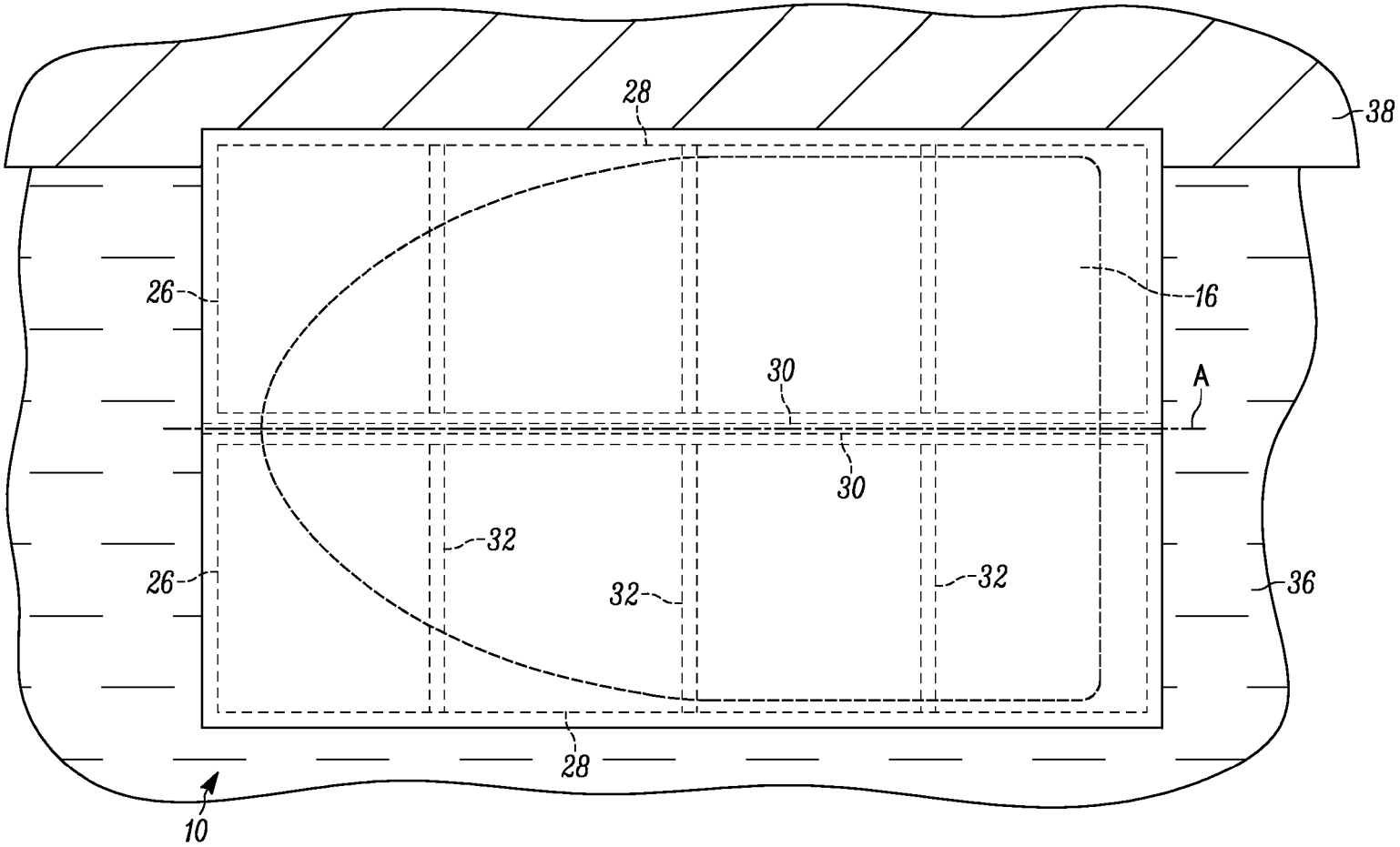
FIG. 10 illustrates a top elevational view of the exemplary canopy assembly shown in FIG. 3.

In another embodiment, referring to FIG. 9, a similar canopy assembly 10 to FIG. 8 is shown. In this embodiment the canopy includes a lift support rod 48 that is extendable or moveable to a raised position to support the second frame half 24. However, when the second frame half 24 is lowered the lift support rod 48 collapses or is retracted into a holder dispose within or adjacent to support member 34.

In another embodiment, referring to FIG. 11, the canopy assembly 10 includes a lift assist 40 that is attached directly to a support member 34, through suitable fasteners and brackets or other fastening technique. Specifically, a base portion of the lift assist is vertically orientated and attached through fasteners, brackets or otherwise to provide a low cost lift system that is usable with both new systems and existing systems. With respect to operation, the single frame member 23 is rotatably attached to support members 34 on a first side and attached to the lift assist 40 on a second side, which may also comprise a pivoting attachment. In an alternate configuration, it is contemplated that the canopy assembly 10 shown in FIG. 11 does not include a lift assist 40, but instead, includes features such as gears, support rods or otherwise for maintaining the second frame half 24 in a raised position. Similarly, it should be appreciated that any of the embodiments described herein may be configured without a lift assist 40 and instead includes support rods, gears or otherwise for maintaining the first frame half 22, second frame half 24 frame, or single frame member 23 in a raised position.

In another embodiment, referring to FIG. 12, the canopy assembly 10 does not include a lift assist 40 but instead linkage or guide members formed between the first frame half 22 and second frame half 24 for guiding the second frame half over and on top of the second frame half. In this configuration, the linkage or guide members may be formed by or attached to the first frame half 22, second frame half 24 or both to guide the second frame half to a deployed position where it is extending away from the first frame half and supported by support members 34 and a stowed position where it is positioned over and supported by the first frame half. In a modified configuration, the canopy assembly 10 is free of linkage or guide members but alternatively the second frame half 24 is larger than the first frame half 22 to allow the second frame half to be placed over the first frame half. It is contemplated that connectors are provided for connecting the second frame half 24 to the first frame half 22, support members 34 or both during deployment thereof.

Other advantageous features of the present invention are provided for assisting in the use of the canopy assembly 10 of the present invention. For example, in one exemplary embodiment the canopy assembly 10 further includes a latch 42 for engaging or disengaging the first or second frame half 22, 24 from the other of said first or second frame half. For example, in one configuration the latch 42 disengages the first frame half 22 from the second frame half 24 allowing the lift assist to rotate the second frame half 24 with respect to the first frame half 22. In another configuration, the latch disengages the second frame half 24 from the support members 34 allowing the lift assist 40 to rotate the second frame half with respect to the first frame half 22. Through particular configurations including linkages, it should be appreciated that one or more latches 42 may be provided in an internal region of the canopy assembly 10 or an external region of the canopy assembly such that the canopy assembly may be raised by an individual within the marine vessel 16 or outside of the marine vessel, such as on the dock 38. It is contemplated that any suitable latch may be used to engage or disengage the first or second frame half 22, 24 with respect to the other of said first or second frame half, or otherwise.

Another advantageous feature includes one or more position stops 43 for positioning the second frame half 24 with respect to the first frame half 22. These position stops may be located between end fame members 26, internal side frame members 30, lateral support frame members 32 or otherwise. Yet another advantageous feature includes one or more tie-downs 44, e.g. elastic cords, rope, wire or otherwise, for attaching the canopy 14 to the individual frame members of the first and second frame halves 22, 24.

Figure 2:
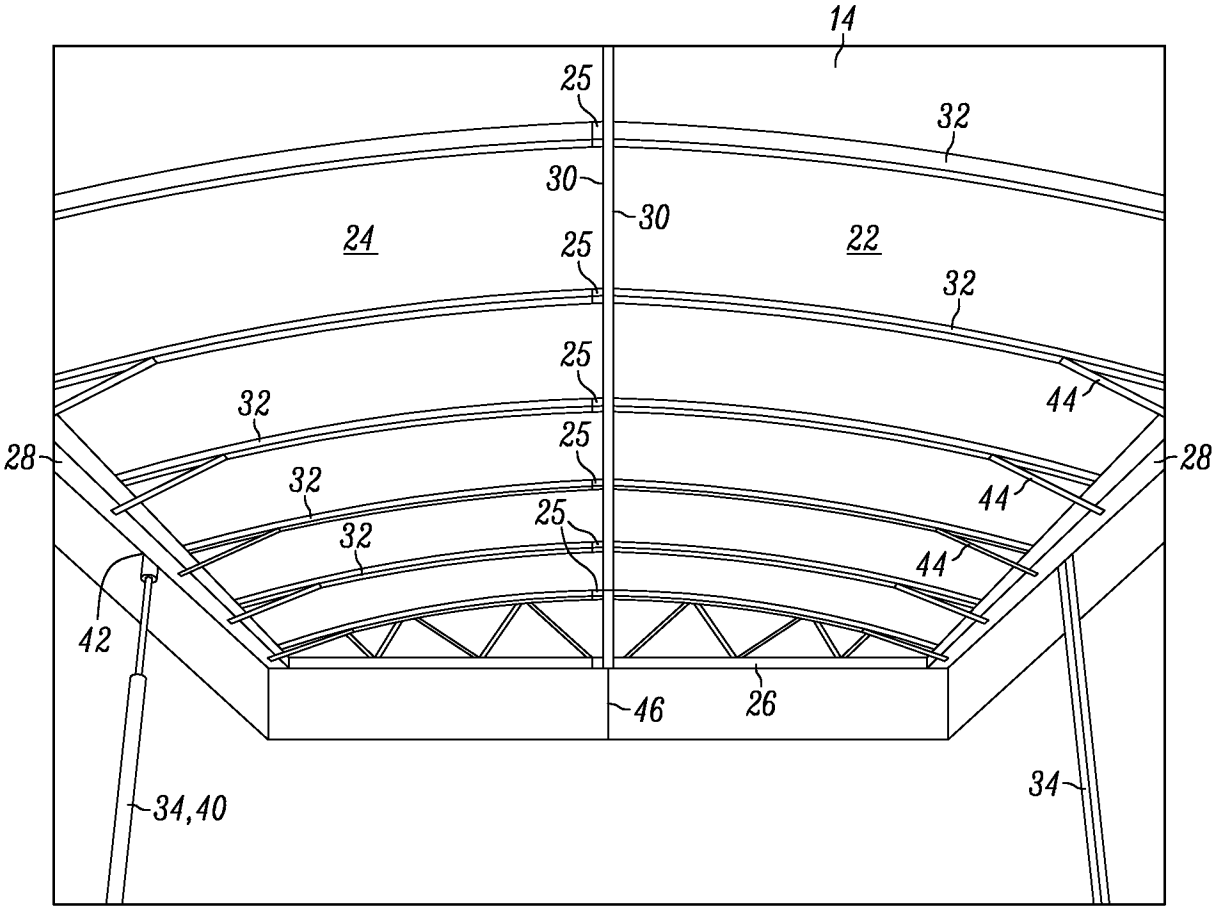
FIG. 2 illustrates a perspective view of another exemplary embodiment of a canopy assembly of the present invention.

Referring to FIG. 2, in one exemplary embodiment the canopy 14 includes a split 46 for facilitating in the rotation of the first frame half 22 with respect to the second frame half 24. In another exemplary embodiment, it is contemplated that the canopy, or a portion thereof, is elastic or otherwise stretchable to facilitate in rotation of the first frame half 22 with respect to the second frame half 24.

In operation, the marine vessel 16 is positioned under the canopy assembly 10. The user then unlatches the first and/or second frame half 22, 24 to allow rotation and raising of the first or second frame half or a side of the single frame member 23 with respect to the other of said first or second frame halve or other side of the single frame member 23, via the lift assist 40. After the user exits the marine vehicle 16, the user can cause the lift assist 40 to lower the second frame half or otherwise push the second frame half down to latch the second frame half to the first frame halve 22.

In another exemplary embodiment, it is contemplated that as opposed to only the external side frame members 28 of the first and second frame halves 22, 24 raising, that the internal side frame members 30 alternatively raise, or also raise, through additional or alternate lift assists 40 and/or latches 42. In this configuration, as the marine vessel 16 approaches the canopy assembly 10 the internal side frame members 30 of the first and second frame halves 22, 24 are unlatched and raised, via lift assist 40 or otherwise, to allow easy entrance of the marine vessel under the canopy assembly. After the marine vessel 16 is parked, the internal side frame members 30 are lower and/or external side frames members 28 are raised, via another lift assist 40, latch 42 and/or otherwise, to allow easy egress from the marine vehicle. After leaving the marine vehicle 16, the internal and/or external frame members 28, 30 are lowered to provide secure concealment and protection to the marine vessel. In one exemplary embodiment, it is further contemplated that the latch further includes a lock or remote is encoded to prevent unauthorized access. It should be appreciated that other operational sequences are possible given the embodiments shown and described herein.

The components of the canopy assembly 10 may be formed of any suitable material. In one preferred configuration, the materials forming the canopy are resistant to damaging conditions commonly found in marine environments. Examples of suitable materials forming the frame assembly includes metals, plastics, combinations thereof, or otherwise. Examples of suitable materials forming the canopy include cloth, nylon, vinyl, any marine grade fabric or otherwise.

While the invention has been described with reference to a preferred embodiment it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A marine assembly, comprising:

a frame assembly including a first frame portion rotatably connected to a second frame portion through a hinge, the first frame portion rotatable between a first and second position;

first and second support members supporting the first frame portion and the second frame portion, the first and second frame portions substantially horizontal on a top portion of the first and second support members, wherein the distance between the first and second support members with the first frame portion in the first position is substantially equal to the distance between the first and second support members with the first frame portion in the second position, wherein the first frame portion covers a first portion of the area between the first and second support members and the second frame portion only covers the remaining portion of the area between the first and second members in the first position;

a flexible canopy providing cover to the first and second support members having a split in a front portion thereof for facilitating the rotation of the first frame portion with respect to the second frame portion;

a position stop for positioning the second frame portion with respect to the first frame portion located therebetween;

a marine vessel disposed substantially under the frame assembly; and a lift assist configured to maintain a raised position of the first frame portion substantially above the second frame portion, the lift assist fixedly coupled to a surface of the first or second support member on a first end and attached to the frame assembly on the second end.

2. The marine assembly of claim 1, wherein the first frame portion comprises generally of a first frame half of the frame assembly and the second frame portion comprises generally of a second frame half of the frame assembly.

3. The marine assembly of claim 1, wherein the first frame portion is rotatably attached to the second frame portion through a plurality of hinges disposed along an axis of the frame assembly.

4. The marine assembly of claim 1, wherein the first frame portion is rotatably attached to the second frame portion through a single hinge extending from a first end portion of the frame assembly to a second end portion of the frame assembly.

5. The marine assembly of claim 1, wherein the lift assist and one of the support members are integrated into a single component.

6. The marine assembly of claim 1, wherein the lift assist comprises a pneumatically actuated lift assist, a hydraulically actuated lift assist, a mechanically actuated lift assist, an electrically actuated lift assist or combinations thereof that are configured to have variable lengths from one thereof to the opposing end in a retracted and deployed position.

7. The marine assembly of claim 1, further comprising:

a latch configured to maintain position of the first frame portion with respect to the second frame portion, wherein the latch is coupled to the first frame portion and a latchable component disposed on a vertical, substantially stationary point on the first support member.

8. The marine assembly of claim 7, wherein upon disengagement of the latch with the corresponding latchable component, the first frame portion can rotate with respect to the second frame portion.

9. An assembly for marine vessels comprising:

a frame assembly rotatable between first and second positions; the frame including first and second substantially parallel side portions;

first and second supports supporting the respective first and second side portions, wherein the distance between the first and second support members in the first position is substantially equal to the distance between the first and second support members in the second position;

a bracket directly coupled to the second support member and a hinge, wherein the hinge rotates the frame assembly such that the first side portion is a first distance from the first support member in the first position and is separated from the first support member in the second position by a larger second distance;

a fabric canopy generally disposed over the frame assembly, wherein the first and second support members are covered in the first position and the first support member is partially downwardly exposed in the second position;

a lift assist of variable length from one end thereof to the opposing end coupled to the first support member and frame assembly, wherein a base portion of the lift assist is fixedly pivotable about a point on a vertical portion of the first support member and pivotably attached to the frame assembly on am opposing top portion; and a marine vessel retaining apparatus disposed under the canopy.

10. The assembly for marine vessels of claim 9, further comprising:

one or more latches configured to maintain position of the frame assembly.

11. The assembly for marine vessels of claim 9, wherein a marine vessel may be placed between the first and second supports when the frame assembly is in the first or second position.

12. The assembly for marine vessels of claim 9, further comprising:

a lock assembly coupled to the first or second frame side portion and connectable to a lockable component assembly on the corresponding first or second support.

13. The assembly for marine vessels of claim 9, wherein the lift assist orientation that is substantially parallel to the first support when the frame assembly is in the first position.

* * * * *